United States Patent [19]

Barthes et al.

[11] 4,174,533

[45] Nov. 13, 1979

[54] WAVEFLUX CONCENTRATION REFLECTOR

[75] Inventors: Emile Barthes, Montreuil; Jean-Luc Richard, Puteaux, both of France

[73] Assignee: Compagnie des Lampes, Societe Anonyme, Paris, France

[21] Appl. No.: 838,475

[22] Filed: Oct. 3, 1977

[30] Foreign Application Priority Data

Oct. 21, 1976 [FR] France ..... 76 31685

[51] Int. Cl.[2] ..... F21V 7/00

[52] U.S. Cl. ..... 362/346; 362/278; 362/303

[58] Field of Search ..... 362/297, 298, 303, 346, 362/348

[56] References Cited

U.S. PATENT DOCUMENTS

| | | | |
|---|---|---|---|
| 2,755,374 | 7/1956 | Ott et al. | 362/297 X |
| 3,609,340 | 9/1971 | Habro | 362/303 |
| 4,006,355 | 2/1977 | Shemitz et al. | 362/297 X |
| 4,034,217 | 7/1977 | Dumont | 362/297 X |

FOREIGN PATENT DOCUMENTS

| | | | |
|---|---|---|---|
| 240317 | 6/1960 | Australia | 362/297 |
| 247947 | 8/1911 | Fed. Rep. of Germany | 362/297 |
| 388781 | 1/1924 | Fed. Rep. of Germany | 362/297 |
| 464126 | 12/1968 | Switzerland | 362/297 |
| 255192 | 7/1926 | United Kingdom | 362/297 |

*Primary Examiner*—Peter A. Nelson

[57] ABSTRACT

In a structure comprising a first, through-shaped reflector and a second reflector consisting of two parabolic portions derived from a parabola of which the axis forms a certain angle with the main axis of waveflux emission of the device, the two parabolic portions are so shaped and disposed as to have a certain symmetry in relation to the main axis of the emergent beam, so that a secondary emission can be obtained in a privileged direction other than that of the main beam axis.

4 Claims, 4 Drawing Figures

20
21
19
17
24
18
5
6
23
22
8
4
4
1
13
β
14
25
12
10
11
9
7
2
3
5
15
α
14
α
16
2

20
21
17
19
18
24
5
6
4
1
13
14
7
13a
8
12
10
9
11
25
3
2
14a
22
23
15
16
y

WAVEFLUX CONCENTRATION REFLECTOR

BACKGROUND OF THE INVENTION

1. Field of the Invention

The present invention relates to a reflecting device comprising on the one hand a first trough-shaped reflector of which a median cross-section contains a main axis of propagation of an emergent waveflux from this reflector, the latter comprising a parabolic section having its focus coicident with an emissive area of a source producing said waveflux, and on the other hand a second reflector arranged inside the first reflector and downstream of said source for controlling in aperture that portion of the waveflux which is defined within a solid angle formed by two generatrices extending from the flux emitting area to outer edges of the first reflector, a plane section of the second reflector, which contains the main axis of propagation of the emitted waveflux, being formed by at least two parabolic portions of which the common focus lies in said waveflux emitting area.

2. Description of the Prior Art

It is already old in the art to concentrate the flux emitted from a source, notably a light source, to form a beam of controlled aperture, by utilizing an optical device having a parabolic or elliptic section and by disposing the source at the focus of this section.

It is also known to utilize a secondary optical device for reducing the over-all dimensions of the main optical device. However, in hitherto known structures of this last-mentioned type, i.e. comprising a main optical device and a secondary optical device, the relative position of the two devices cannot under any circumstances provide simultaneously a satisfactory convergence of the emitted flux, avoid multiple reflections and effect a maximal recovery of the emitted flux without causing the latter to be returned at least partially to its source.

Now such multiple reflections imply a considerable loss of radiating power in the form of heat, which is noxious to the optical device itself and also to source, this causing a reduction in the efficiency of the device; on the other hand, the problem of recovering the power flux is particularly acute in the case of a linear source associated with a trough-shaped reflector. In fact, in this case the aperture of the flux radiated from the source in the plane of the complete median cross-section between the two side edges of the trough is strictly equal to 360°, so that a relatively large amount of flux is emitted backwards. In some known reflectors this recovery of the backward flux is obtained by increasing the dimensions and therefore the cumbersomeness of the optical device, or by endeavoring to take advantage of multiple reflections, thus increasing the above-described inconveniences.

SUMMARY OF THE INVENTION

It is the essential object of the present invention to provide a device comprising a main reflector and a secondary reflector in a structure so arranged that the aperture of the emergent beam can be controlled efficiently at the cost of only a small increment in the reflecting surface areas, while avoiding undue or unnecessary multiple reflections. In the most elaborate form of embodiment of this device the structure further affords an efficient recovery of any backward flux without involving any critical increment in the number of reflexions and without modifying the control of the emergent beam aperture.

According to one of the various possible forms of embodiment of this device, a secondary emission, notably of light waves, can be obtained in a privileged direction other than that of the main beam axis.

The reflecting device according to the present invention is characterized essentially in that the position of each parabolic portion of the plane section of the second reflector is deducted from the position of one portion of one branch of a parabola having its axis coincident with that of the main emergent beam, the focus of said branch being coincident with the emitting area of said source, by rotating this parabolic branch about said focus.

In order to afford a clearer understanding of this invention and of the manner in which the same may be carried out in actual practice, two typical forms of embodiment thereof will now be described by way of example with reference to the accompanying drawing, in which:

DESCRIPTION OF THE PREFERRED EMBODIMENT

Figures 1, 2:
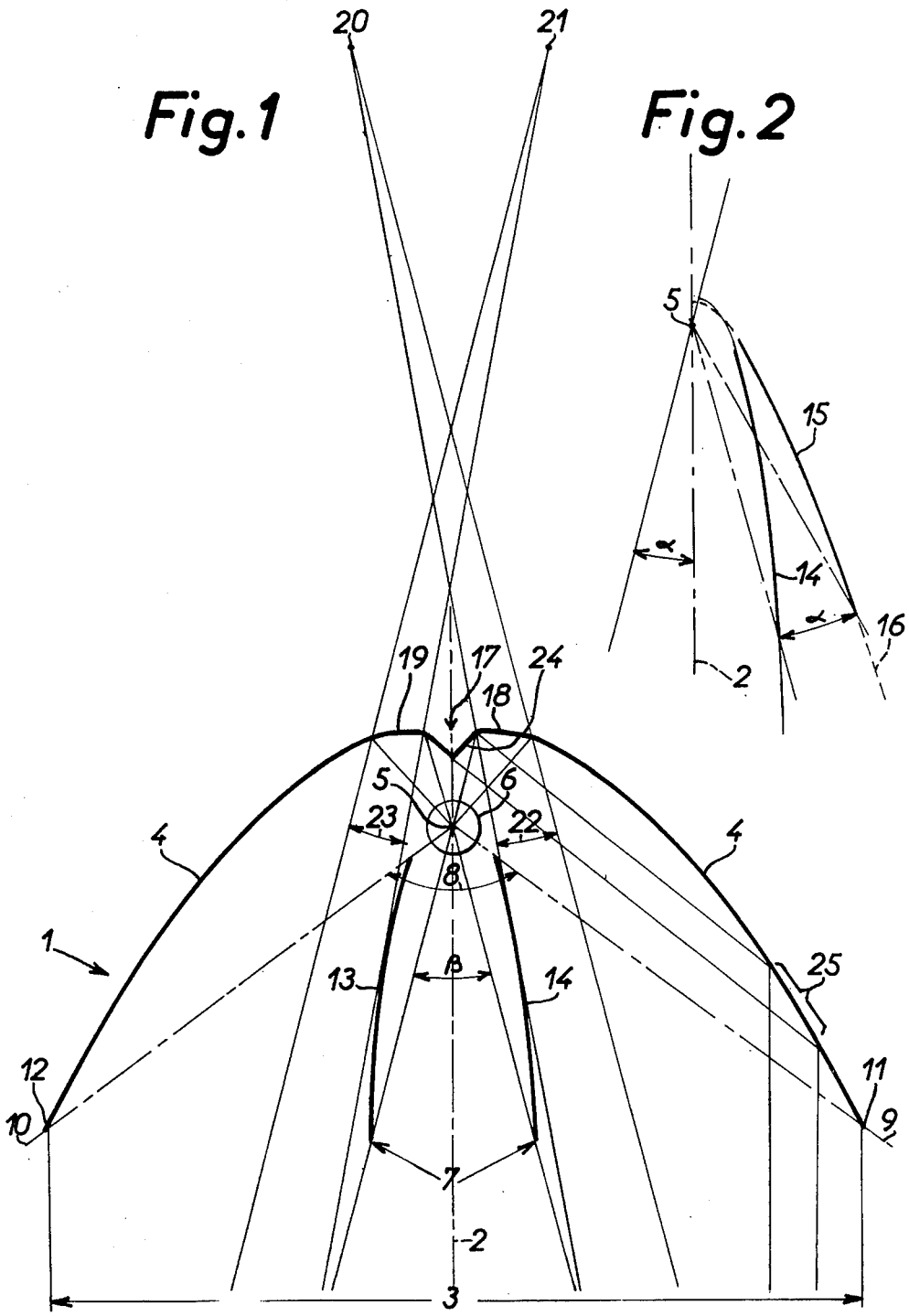
FIG. 1 is a diagrammatical sectional view of the reflecting device according to the invention; the section is taken along a plane perpendicular to the trough-shaped reflector, at any location between the ends thereof.
FIG. 2 shows a detail of the device of FIG. 1.

The device according to the present invention comprises a first trough-shaped reflector of which the cross-section 1 contains the main axis 2 of propagation of the emergent waveflux 3. This cross-section 1 of the first reflector comprises a parabolic portion 4. The flux emitting area 5 of source 6 is preferably coincident with, or merges into, the focus 5 of the parabolic portion 4 of the first reflector 1. The device further comprises, downstream of said source 6, a second reflector 7 disposed within the first reflector 1 for controlling the aperture of one portion 8 of the waveflux defined by a solid angle formed between a pair of generatrices 9 and 10 extending from the flux emitting area 5 to the outer edges 11, 12 of the first reflector 1. In a plane section containing the axis 2 of propagation of the emergent beam 3 the second reflector 7 is shown as consisting of a pair of registering parabolic portions 13, 14 having a common focus located in close vicinity of the emission area 5.

The pair of longitudinal blades constituting this reflector 7 are held, for example by riveting, in end plates (not shown) constituting the end walls of the inverted trough forming the first reflector 1.

Figures 3, 4:
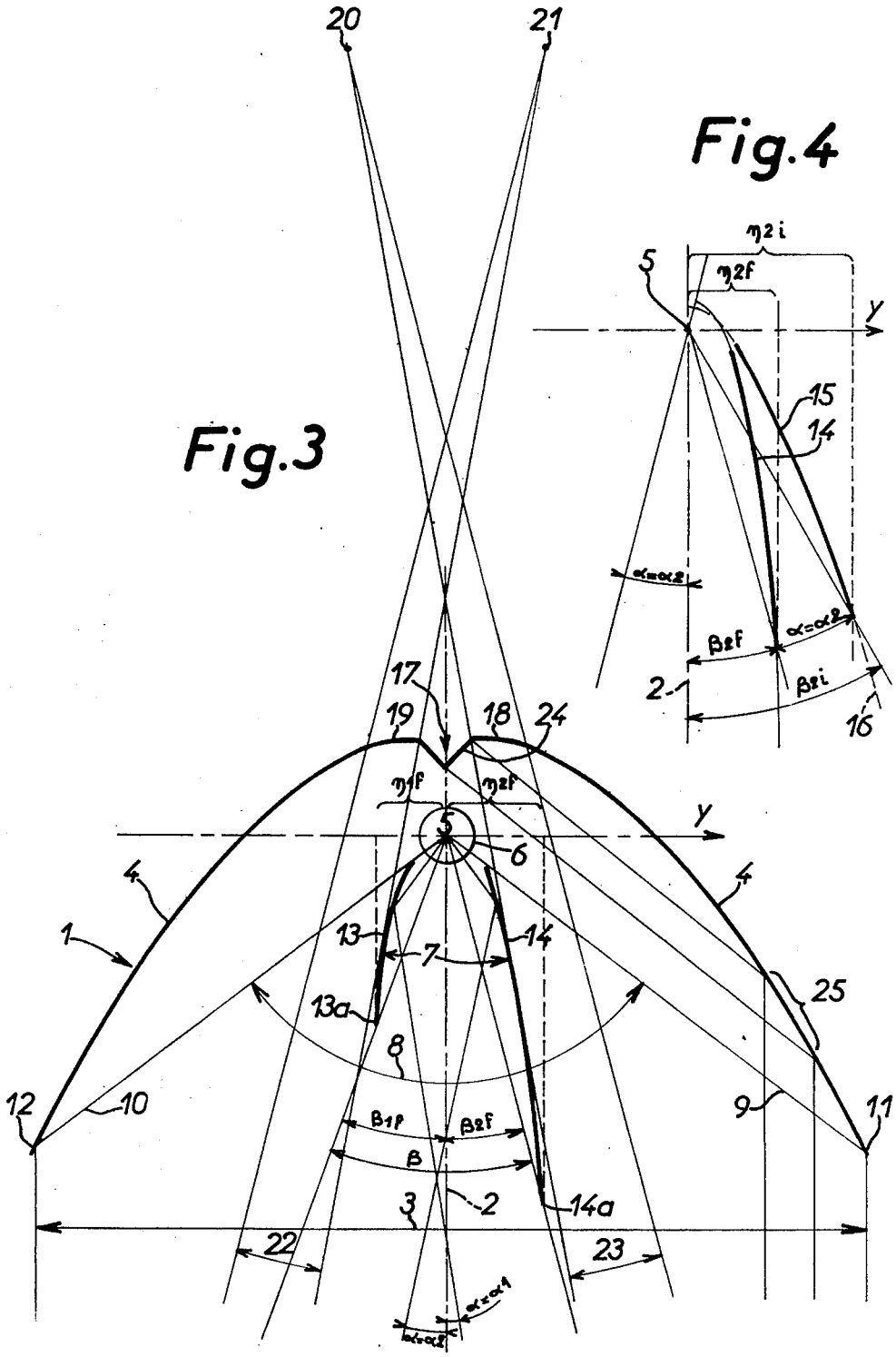
FIG. 3 is a view similar to FIG. 1 but showing a modified form of embodiment of the invention.
FIG. 4 shows a detail of the device of FIG. 3.

As shown in FIGS. 2 and 4, the position of each blade 13, 14 constituting this second reflector 7 and having a parabolic configuration is deducted from the position of one portion 15 of a branch 16 of a parabola of which the axis is coincident with the axis of the main emergent beam 3 and the focus lies at said flux emitting area 5, by rotating said portion 15 of parabolic branch 16 about said focus 5 through a certain angle $\alpha$ the value of which depends on the desired aperture $\beta$ of waveflux portion 8.

It will be readily understood, notably if reference is made to FIGS. 2 and 4, that an obvious relationship between the aperture angle of waveflux portion 8, on the one hand and the angle of rotation of a single portion 13 or 14 of the parabola, on the other hand, is that the aperture angle decreases (from an initial aperture angle defined by the constructional characteristics of the parabolic portions of reflector 7) as the angle of rotation $\alpha$ of the portion 13 or 14 involved increases.

FIG. 1 illustrates a reflector obtained by rotating each one of the parabolic portions, having the same length, through a same angle $\alpha$, so that the obvious relationship between the aperture angle of flux portion 8 and the angle of rotation of the two parabolic portions can be expressed mathematically through the fact that the sum $\beta+2\alpha$ is constant and more particularly equal to the aperture angle of the second reflector before the two portions of the parabola are rotated; moreover, the parabolic portions 13 and 14 are illustrated in FIG. 1 as being derived from a same parabola, i.e. as having a same mathematical parameter.

The cross section of the first reflector 1 comprises, in the vicinity of its vertex 17, two hyperbolic portions 18, 19 disposed symmetrically in relation to the vertex 17. The vertical cross section of each hyperbolic portion 18 and 19 has a first focus in the waveflux emitting area 5; the locations of the second foci 20 and 21, respectively, of each hyperbolic portion 18, 19 are so selected that the beams 22 and 23 reflected by each hyperbolic portion 18, 19 respectively passes between the second reflector 7 and the outer edges 11 and 12, respectively, of the first reflector 1. The vertex 17 of the vertical cross section of first reflector 1 may have an orifice formed therethrough but, as shown in FIGS. 1 and 3 it will preferably comprise a substantially V-shaped portion 24 having its sides so disposed that the waves impinging thereagainst from the emitting area 5 are reflected into said emergent beam 3 by only one complementary reflection 25 on the surface of said reflector 1.

FIGS. 3 and 4 illustrate a modified embodiment of the device illustrated in FIGS. 1 and 2; in this structure, the two parabolic portions 13 and 14 of the vertical section of said second reflector 7 differ from each other by at least one of three features, namely: the distance from their outermost edges 13*a*, 14*a* to the main axis 2 of the reflector; the value of the angle through which they are rotated about the focus 5 and the value of the parameter defining the parabola from which each parabolic portion is derived.

Preferably, the parabolic portions 13 and 14 differ at least by the value of the angle defining their rotation about the focus, and possibly, in addition, by the parameter defining the parabola from which each portion is derived.

Let us consider an ortho-standardized plane reference containing the main axis 2 constituting the x-axis (abscissae) and the y-axis perpendicular constituting the coordinate axis:

if two indices i and f are introduced for characterizing any magnitude defined before and after the rotation of the parabolic portions, respectively (i=initial, f=final), if we note as follows:

$\alpha_1$ the angle of rotation of parabolic portion 13, $\alpha_2$ the angle of rotation of parabolic portion 14, $p_1$ the parameter of the parabola from which portion 13 is derived, $p_2$ the parameter of the parabola from which portion 14 is derived, $\eta_1$ and $\eta_2$ the (positive) values of the distances measured from the outermost edges 13*a* and 14*a* of parabolic portions 13 and 14, respectively to the main axis, $\eta_{1i}$, $\eta_{2i}$ and $\eta_{1f}$, $\eta_{2f}$ the value of the same distances before and after the rotation of the parabolic portions, respectively, the modified embodiment illustrated in FIGS. 3 and 4 is such that the following three requirements are met:

If $\alpha_1=\alpha_2$ and $P_1=P_2$, then $\eta_{1f}\neq\eta_{2f}$

If $\alpha_1=\alpha_2$ and $\eta_{1f}=\eta_{2f}$, then $P_1\neq P_2$ and if $P_1=P_2$ and $\eta_{1f}=\eta_{2f}$, then $\alpha_1\neq\alpha_2$.

Moreover, if $\beta_1$ and $\beta_2$ designate the aperture portions of flux sector 8 which on either side of the main axis 2 are adjacent the parabolic portions 13 and 14, respectively so that $\beta_{1f}$ and $\beta_{2f}=\beta$, the elementary trigonometry and the general equation of parabolas in the above-defined plane reference will give the following relationships:

$$tg\beta_{1i}=\frac{2P_1\cdot\eta_{1i}}{\eta_{1i}^2-P_1^2}\text{ and }tg\beta_{2i}=\frac{2P_2\cdot\eta_{2i}}{\eta_{2i}^2-P_2^2}$$

$$\text{or }\alpha_1=\beta_{1i}-\beta_{1f}\text{ and }\alpha_2=\beta_{2i}-\beta_{2f}$$

$$\text{that }\alpha_1=\text{Arc}tg\frac{2P_1\cdot\eta_{1i}}{\eta_{1i}^2-P_1^2}-\beta_{1f}$$

$$\text{and }\alpha_2=\text{Arc}tg\frac{2P_2\cdot\eta_{2i}}{\eta_{2i}^2-P_2^2}-\beta_{2f}$$

$$\text{and finally }\alpha_1+\alpha_2=\text{Arc}tg\frac{2P_1\cdot\eta_{1i}}{\eta_{1i}^2-P_1^2}+\text{Arc}tg\frac{2P_2\cdot\eta_{2i}}{\eta_{2i}^2-P_2^2}-\beta$$

This expression is the developed mathematical form of the relationship existing between the angles of rotation $\alpha_1$ and $\alpha_2$ of the parabolic portions 13 and 14, on the one hand, and the desired aperture angle, $\beta$ on the other hand, through the medium of terms which are subordinate only on the shape and length of the parabolic branches selected for constructing the second reflector 7.

The reflecting device according to this modified embodiment of the present invention, may be mounted on a tower and used for example for illuminating a football pitch and, at the same time, the base of the tower.

This invention should not be construed as being limited to the specific forms of embodiment described hereinabove with reference more particularly to trough-shaped reflectors associated with a linear light source, since many modifications and changes may be brought thereto, and different applications may be contemplated, without departing from the basic principles of the invention, provided that the modified structures contemplated, as far as the same laws of geometrical optics are concerned, are equivalent to the devices disclosed herein.

It is also obvious that the surfaces referred to as "parabolic" or "hyperbolic" ones should not be considered only in their strictly mathematical meaning.

Thus, notably, the surfaces referred to as "parabolic" or "hyperbolic" ones in the above description may consist of adjacent, substantially flat facets tangent to the mathematical envelope of a parabola or a hyperbola.

What is claimed as new is:

1. An optical reflecting device for concentrating a waveflux produced by a luminous source into a beam of light having a main plane, said device comprising an outer trough-shaped reflector and an inner reflector, said outer reflector comprising, on each side of said main plane, adjacent first and second reflecting surfaces, and said inner reflector comprising, on each side of said main plane, a third reflecting surface, a transverse cross section of said luminous source comprising an emitting area, a transverse cross section of said main plane forming an axis of the beam of light, a transverse cross section of said first reflecting surface being described by an arc of a hyperbola extending between two ends and having a first focus coincident with said emitting area and a second focus, a transverse cross section of said second reflecting surface being described by a first arc of a parabola having an axis coincident with the axis of the beam of light, and a focus coincident with said emitting area, and a transverse cross section of said third reflecting surface being described by a second arc of a parabola having a focus coincident with said emitting area and an axis forming an angle with the axis of the light beam, said second arc of parabola being closer to the axis of said beam of light than to its axis, and the second focus of said arc of hyperbola being positioned at a crossing point of two straight lines passing by the respective ends of said arc of the hyperbola and between said first arc of parabola and said second arc of parabola.

2. An optical reflecting device according to claim 1, wherein the transverse cross section of said outer reflector comprises, adjacent to each arc of hyperbola, a substantially V shaped portion having a concavity directed in a direction opposite said beam of light.

3. An optical reflecting device according to claim 1, wherein the angles formed between the axis of the beam of light and the respective second arcs of parabola on either side of said axis of the beam of light are different.

4. An optical reflecting device according to claim 1, wherein the second arcs of parabola disposed on either side of the axis of the beam of light have two distinct mathematical parameters.

* * * * *